US011017727B2

(12) United States Patent
Pyo

(10) Patent No.: US 11,017,727 B2
(45) Date of Patent: May 25, 2021

(54) DRIVING VOLTAGE SETTING DEVICE, METHOD OF SETTING DRIVING VOLTAGE FOR DISPLAY DEVICE, AND DISPLAY DEVICE

(71) Applicant: Samsung Display Co., Ltd., Yongin-si (KR)

(72) Inventor: Si Beak Pyo, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 107 days.

(21) Appl. No.: 16/364,073

(22) Filed: Mar. 25, 2019

(65) Prior Publication Data

US 2019/0340981 A1 Nov. 7, 2019

(30) Foreign Application Priority Data

May 3, 2018 (KR) ..... 10-2018-0051333

(51) Int. Cl.
*G09G 3/3291* (2016.01)
*G09G 3/20* (2006.01)

(52) U.S. Cl.
CPC ..... *G09G 3/3291* (2013.01); *G09G 3/2007* (2013.01); *G09G 2310/027* (2013.01); *G09G 2320/0242* (2013.01); *G09G 2320/0257* (2013.01); *G09G 2320/0653* (2013.01); *G09G 2360/16* (2013.01)

(58) Field of Classification Search
CPC ..... G09G 3/3291
See application file for complete search history.

(56) References Cited

U.S. PATENT DOCUMENTS 8,451,554 B2 5/2013 Kim et al.
8,982,164 B2 3/2015 Pyo
9,013,519 B2 4/2015 Park et al.
(Continued)

FOREIGN PATENT DOCUMENTS

CN 103198779 7/2013
KR 10-2010-0090975 8/2010
(Continued)

OTHER PUBLICATIONS

Extended European Search Report dated Aug. 26, 2019, in European Patent Application No. 19172155.4.

*Primary Examiner* — Gustavo Polo
(74) *Attorney, Agent, or Firm* — H.C. Park & Associates, PLC

(57) ABSTRACT

A driving voltage setting device includes a first voltage determiner, a luminance measurer, and a second voltage determiner. The first voltage determiner is configured to: determine, based on a variable preliminary black gray scale voltage (BGSV) under a first display luminance condition, a first BGSV corresponding to a first display luminance of a display device; and determine, based on the variable preliminary BGSV under a second display luminance condition, a second BGSV corresponding to a second display luminance of the display device. The luminance measurer is configured to measure a luminance of a BGSV of the display device using the variable preliminary BGSV. The second voltage determiner is configured to determine, based on the first BGSV and the second BGSV, BGSVs respectively corresponding to a plurality of preset display luminances between the first display luminance and the second display luminance.

19 Claims, 11 Drawing Sheets

(56) References Cited

U.S. PATENT DOCUMENTS

| | | | |
|---|---|---|---|
| 9,478,166 | B2 | 10/2016 | Pyo et al. |
| 9,953,573 | B2 | 4/2018 | Pyo et al. |
| 2013/0176349 | A1 | 7/2013 | Park et al. |
| 2016/0275842 | A1 | 9/2016 | Seok |
| 2017/0011682 | A1 | 1/2017 | Pyo et al. |
| 2017/0076695 | A1 | 3/2017 | Hwang et al. |
| 2017/0124958 | A1 | 5/2017 | Pyo et al. |
| 2017/0132975 | A1 | 5/2017 | Park et al. |
| 2017/0294156 | A1 | 10/2017 | Pyo et al. |

FOREIGN PATENT DOCUMENTS

| | | |
|---|---|---|
| KR | 10-2015-0010807 | 1/2015 |
| KR | 10-2015-0142830 | 12/2015 |
| KR | 10-2017-0055584 | 5/2017 |
| KR | 10-2017-0066771 | 6/2017 |
| KR | 10-2017-0121378 | 11/2017 |

FIRST DISPLAY LUMINANCE CONDITION
(750nit)

| P_VREG | ML(nit) |
|---|---|
| 6.7 | 0.0008 |
| 6.6 | 0.0008 |
| 6.5 | 0.0008 |
| 6.4 | 0.0010 |
| 6.3 | 0.0009 |
| 6.2 | 0.0006 |
| VREG1 → 6.1 | 0.0006 |
| 6.0 | 0.0084 |
| 5.9 | 0.1722 |
| 5.8 | 0.4572 |
| 5.9 | 0.8802 |

FIG. 10

SECOND DISPLAY LUMINANCE CONDITION
(2nit)

| | P_VREG | ML(nit) |
|---|---|---|
| | 6.7 | 0.0007 |
| | 6.6 | 0.0009 |
| | 6.5 | 0.0008 |
| | 6.4 | 0.0006 |
| | 6.3 | 0.0008 |
| | 6.2 | 0.0007 |
| | 6.1 | 0.0009 |
| | 6.0 | 0.0008 |
| | 5.9 | 0.0008 |
| | 5.8 | 0.0008 |
| | 5.7 | 0.0007 |
| | 5.6 | 0.0008 |
| | 5.5 | 0.0006 |
| | 5.4 | 0.0008 |
| | 5.3 | 0.0009 |
| VREG2 → | 5.2 | 0.0008 |
| | 5.1 | 0.0075 |

| DISPLAY LUMINANCE (nit) | EMISISON OFF DUTY (%) | VREG (V) | DIMMING MODE |
|---|---|---|---|
| 750 | 2.9 | 6.1 (VREG1) | GAMMA DIMMING |
| 650 | 2.9 | 6.1 | |
| 300 | 2,9 | 6.1 | |
| 100 | 2,9 | 6.0 (VREG3) | |
| 60 | 41.8 | 5.9 | AID DIMMING |
| 30 | 70.9 | 5.8 | |
| 15 | 85.4 | 5.6 | |
| 10 | 90.3 | 5.5 | |
| 7 | 93.2 | 5.5 | |
| 4 | 96.1 | 5.3 | |
| 2 | 98.1 | 5.2 (VREG2) | |

DRIVING VOLTAGE SETTING DEVICE, METHOD OF SETTING DRIVING VOLTAGE FOR DISPLAY DEVICE, AND DISPLAY DEVICE

CROSS-REFERENCE TO RELATED APPLICATION

This application claims priority from and the benefit of Korean Patent Application No. 10-2018-0051333, filed May 3, 2018, which is hereby incorporated by reference for all purposes as if fully set forth herein.

BACKGROUND

Field

Exemplary embodiments generally relate to an electronic device, and more particularly, to a driving voltage setting device to set a driving voltage for a display device, a method of setting a driving voltage for a display device, and a display device.

Discussion

To reduce manufacturing cost, a plurality of display devices can be simultaneously formed on a large-area mother substrate, and manufacturing equipment may separate the display devices into individual display devices by scribing the mother substrate. It is noted, however, that the individual display devices may have luminance variations with respect to the same driving voltage due to a property of a material, a characteristic change caused by an ambient environment, etc. To address this luminance variation issue, a large margin value was conventionally provided to set voltage values. As such, unnecessary power consumption of the individual display devices may be increased. In addition, an afterimage, color shift, and/or the like, may be viewed due, at least in part, to an unnecessarily large swing range of a data voltage even in low-luminance or low-gray scale display situations.

The above information disclosed in this section is only for understanding the background of the inventive concepts, and, therefore, may contain information that does not form prior art.

SUMMARY

Some exemplary embodiments provide a driving voltage setting device capable of adaptively setting a black gray scale voltage corresponding to each display luminance for one or more display devices.

Some exemplary embodiments provide a method capable of adaptively setting a back gray scale voltage corresponding to each display luminance for one or more display devices.

Some exemplary embodiments provide a display device capable of adaptively setting a back gray scale voltage corresponding to each display luminance.

Additional aspects will be set forth in the detailed description which follows, and, in part, will be apparent from the disclosure, or may be learned by practice of the inventive concepts.

According to some exemplary embodiments, a driving voltage setting device includes a first voltage determiner, a luminance measurer, and a second driving voltage determiner. The first voltage determiner is configured to: determine, based on a variable preliminary black gray scale voltage under a first display luminance condition, a first black gray scale voltage corresponding to a first display luminance of a display device; and determine, based on the variable preliminary black gray scale voltage under a second display luminance condition, a second black gray scale voltage corresponding to a second display luminance of the display device. The luminance measurer is configured to measure a luminance of a black gray scale of the display device using the variable preliminary black gray scale voltage. The second voltage determiner is configured to determine, based on the first black gray scale voltage and the second black gray scale voltage, black gray scale voltages respectively corresponding to a plurality of preset display luminances between the first display luminance and the second display luminance.

According to some exemplary embodiments, method of setting a driving voltage for a display device includes: determining low-power voltages and initialization voltages that respectively correspond to preset display luminances such that light emitting elements of the display device are driven in a saturation region with respect to the respective display luminances; determining a first black gray scale voltage corresponding to a maximum display luminance of the display device based on a variable preliminary black gray scale voltage under a maximum luminance condition; determining a second black gray scale voltage corresponding to a minimum display luminance of the display device based on the variable preliminary black gray scale voltage under a minimum luminance condition; and determining black gray scale voltages corresponding to the respective display luminances, except the maximum display luminance and the minimum display luminance, based on the first black gray scale voltage and the second black gray scale voltage.

According to some exemplary embodiments, a display device includes a display panel, a controller, a scan driver, and a data driver. The display panel includes a plurality of pixels. The controller is configured to control, according to preset display luminances, each of a low-power voltage and a black gray scale voltage. The scan driver is configured to provide a scan signal to the display panel through a scan line. The data driver is configured to: generate a data voltage corresponding to a display image based on the black gray scale voltage; and provide the data voltage to the display panel through a data line.

The foregoing general description and the following detailed description are exemplary and explanatory and are intended to provide further explanation of the claimed subject matter.

BRIEF DESCRIPTION OF THE DRAWINGS

The accompanying drawings, which are included to provide a further understanding of the inventive concepts, and are incorporated in and constitute a part of this specification, illustrate exemplary embodiments of the inventive concepts, and, together with the description, serve to explain principles of the inventive concepts.

FIG. 10 is a diagram illustrating an example of determining the second black gray scale voltage shown in FIG. 9 according to some exemplary embodiments.

DETAILED DESCRIPTION OF THE ILLUSTRATED EMBODIMENTS

Figure 1:
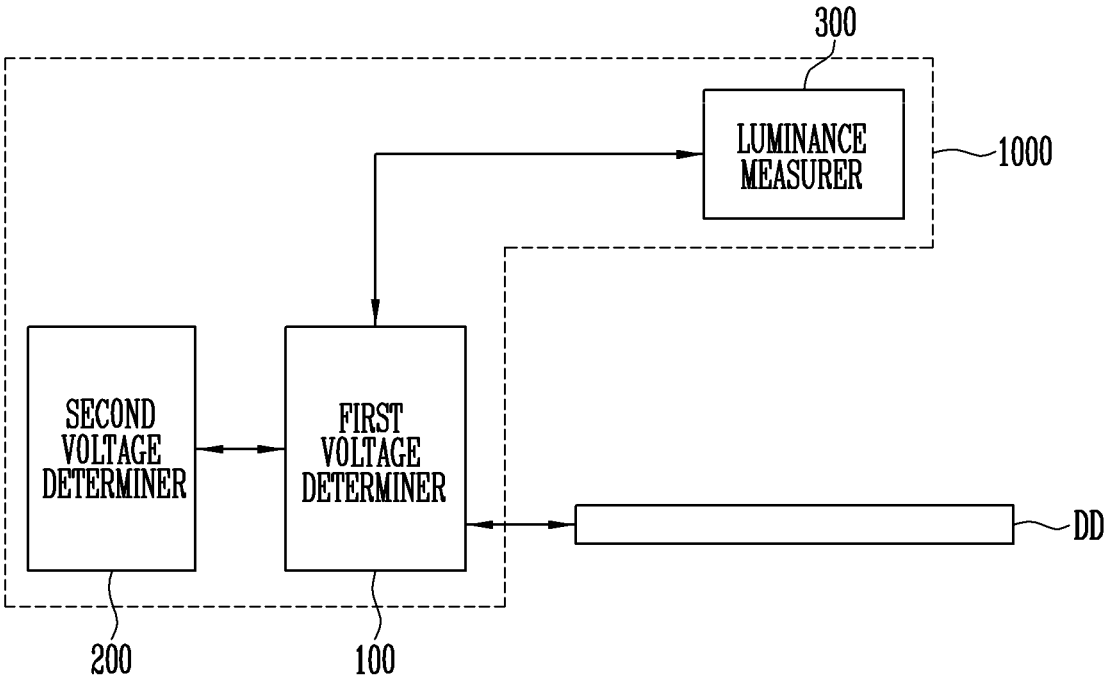
FIG. 1 is a diagram illustrating a driving voltage setting device according to some exemplary embodiments.

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the inventive concepts.

Unless otherwise specified, the illustrated exemplary embodiments are to be understood as providing exemplary features of varying detail of some exemplary embodiments. Therefore, unless otherwise specified, the features, components, modules, layers, films, panels, regions, aspects, etc. (hereinafter individually or collectively referred to as an "element" or "elements"), of the various illustrations may be otherwise combined, separated, interchanged, and/or rearranged without departing from the inventive concepts.

In the accompanying drawings, the size and relative sizes of elements may be exaggerated for clarity and/or descriptive purposes. As such, the sizes and relative sizes of the respective elements are not necessarily limited to the sizes and relative sizes shown in the drawings. When an exemplary embodiment may be implemented differently, a specific process order may be performed differently from the described order. For example, two consecutively described processes may be performed substantially at the same time or performed in an order opposite to the described order. Also, like reference numerals denote like elements.

When an element is referred to as being "on," "connected to," or "coupled to" another element, it may be directly on, connected to, or coupled to the other element or intervening elements may be present. When, however, an element is referred to as being "directly on," "directly connected to," or "directly coupled to" another element, there are no intervening elements present. Other terms and/or phrases used to describe a relationship between elements should be interpreted in a like fashion, e.g., "between" versus "directly between," "adjacent" versus "directly adjacent," "on" versus "directly on," etc. Further, the term "connected" may refer to physical, electrical, and/or fluid connection. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one element's relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and will not be interpreted in an idealized or overly formal sense, unless expressly so defined herein.

As customary in the field, some exemplary embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some exemplary embodiments may be physically separated into two or more interacting and discrete blocks, units, and/or modules without departing from the inventive concepts. Further, the blocks, units, and/or modules of some exemplary embodiments may be physically combined into more complex blocks, units, and/or modules without departing from the inventive concepts Hereinafter, various exemplary embodiments will be explained in detail with reference to the accompanying drawings.

FIG. 1 is a diagram illustrating a driving voltage setting device according to some exemplary embodiments.

Referring to FIG. 1, the driving voltage setting device 1000 may include a first voltage determiner 100, a second voltage determiner 200, and a luminance measurer 300.

The driving voltage setting device 1000 may set a black gray scale voltage (e.g., an optimum black gray scale voltage) corresponding to a driving characteristic of one or more display devices (e.g., display device DD) for each individual display luminance and provide the black gray scale voltage (e.g., the optimum black gray scale voltage) to the various display devices, such as the display device DD. For illustrative and descriptive convenience, the black gray scale voltage will, hereinafter, be referred to as an optimum black gray scale voltage, and reference will be made to the display device DD. In some exemplary embodiments, the driving voltage setting device 1000 may also set a low-power voltage ELVSS and an initialization voltage VINT that can be provided to each pixel of the display device DD for each individual display luminance.

The first voltage determiner 100 may determine a first black gray scale voltage corresponding to a first display luminance of the display device DD based on a variable preliminary black gray scale voltage under a first display luminance condition, and may determine a second black gray scale voltage corresponding to a second display luminance of the display device DD based on the preliminary black gray scale voltage under a second display luminance condition.

In some exemplary embodiments, the first black gray scale voltage may be the largest black gray scale voltage among black gray scale voltages applied to the display device DD, and the second black gray scale voltage may be the smallest black gray scale voltage among the black gray scale voltages. For example, the first black gray scale voltage may correspond to the maximum luminance of the display device DD, and the second black gray scale voltage may correspond to the minimum luminance of the display device DD. That is, the first display luminance may be the maximum luminance with which the display device DD emits light, and the second display luminance may be the minimum luminance with which the display device DD emits light. In other words, the first voltage determiner 100 may determine the maximum black gray scale voltage and the minimum black gray scale voltage. However, this is merely illustrative, and the luminances corresponding to the first black gray scale voltage and the second black gray scale voltage are not limited thereto.

The preliminary black gray scale voltage may be a voltage included in a preset (or predetermined) voltage range, and may be changed within the voltage range based on a determination of the first voltage determiner 100. The first voltage determiner 100 may determine, as the first black gray scale voltage or the second black gray scale voltage, a preliminary black gray scale voltage at which an optimum black gray scale and an optimum black luminance can be expressed at a corresponding display luminance.

The first voltage determiner 100 may provide the preliminary black gray scale voltage to the display device DD. The first voltage determiner 100 may reset the preliminary black gray scale voltage by comparing a preset threshold black luminance and a measured luminance received from the luminance measurer 300 under the first display luminance condition or the second display luminance condition. The first voltage determiner 100 may search for an optimum black gray scale voltage by repeating the comparing of the threshold black luminance and the measured luminance and the resetting of the preliminary black gray scale voltage.

In some exemplary embodiments, the first display luminance condition may include a low-power voltage EVLSS, an initialization voltage VINT, and an off-duty ratio AOR that correspond to the maximum luminance, and the second display luminance condition may include a low-power voltage EVLSS, an initialization voltage VINT, and an off-duty ratio AOR that correspond to the minimum luminance.

The first black gray scale voltage output from the first voltage determiner 100 may be differently determined according to characteristics of the display device DD. Similarly, the second black gray scale voltage may be independently determined for each display device DD.

A more detailed configuration and operation of the first voltage determiner 100 will be described with reference to FIGS. 5 to 9.

The second voltage determiner 200 may calculate (or determine) black gray scale voltages respectively corresponding to a plurality of preset display luminances between the first display luminance and the second display luminance based on the first black gray scale voltage and the second black gray scale voltage. Therefore, the black gray scale voltage may be adaptively changed depending on a change in display luminance of the display device DD.

In some exemplary embodiments, the second voltage determiner 200 may calculate black gray scale voltages respectively corresponding to display luminances by interpolating the second black gray scale voltage and a third black gray scale voltage determined by applying a preset offset to (or from) the first black gray scale voltage. The third black gray scale voltage may correspond to a dimming change display luminance that is a reference where a dimming mode of the display device DD is changed among the display luminances. That is, the third black gray scale voltage may be applied to the dimming change display luminance. For example, a gamma dimming mode may be applied to the display device DD with respect to a luminance higher (or greater) than the dimming change display luminance, and an off-duty ratio AOR adjustment dimming mode may be applied to the display device DD with respect to a luminance lower (or less) than the dimming change display luminance. In some exemplary embodiments, any one of the two dimming modes may be applied with respect to the dimming change display luminance.

For example, the black gray scale voltage may decrease at a preset interval when the display luminance is lowered. Therefore, when the display luminance is lowered, the swing range of a data voltage generated based on the black gray scale voltage may be narrowed. Accordingly, the hysteresis of a driving transistor at a low luminance may be reduced, and an afterimage defect can be minimized or at least reduced.

In some exemplary embodiments, the second voltage determiner 200 may provide the display device DD with black gray scale voltages selected for every display luminance.

In some exemplary embodiments, the first and second voltage determiners 100 and 200 may be configured with a general-purpose or dedicated computing device. The computing device may include a recording medium and a processor. The recording medium and the processor may be included in the same physical device. However, the recording medium and the processor may be included in different physical devices using, for example, a clouding (or cloud computing) technique.

The recording medium may include any kind of recording device in which data or programs readable by the processor can be stored. Examples of the processor-readable recording medium may include, for instance, a read-only-memory (ROM), a random-access-memory (RAM), a compact-disk (CD)-ROM, a magnetic tape, a floppy disk, an optical data storage device, a hard disk, an external hard disk, a solid-state drive (SSD), a universal serial bus (USB) storage device, a digital video disc (DVD), a Blu-ray disk, and/or the like. Also, the processor-readable recording medium may be a combination of a plurality of devices, and may be distributed to computer systems connected through a network.

The luminance measurer 300 may measure a luminance of a black gray scale, which is displayed using the preliminary black gray scale voltage. The luminance measurer 300 may measure a luminance of a black gray scale output from the display device DD based on the preliminary black gray scale voltage under the first display luminance condition. Also, the luminance measurer 300 may measure a luminance of a black gray scale output from the display device DD based on the preliminary black gray scale voltage under the second display luminance condition. The luminance measured by the luminance measurer 300 may be provided to the first voltage determiner 100.

In some exemplary embodiments, the luminance measurer 300 may be configured with an image pickup device, such as an optical camera, an optical sensor, and/or the like.

In some exemplary embodiments, the driving voltage setting device 1000 may further include a third voltage determiner (not shown) for determining a low-power voltage EVLSS and an initialization voltage VINT that correspond to each display luminance such that light emitting elements included in the display device DD are driven in a saturation region with respect to the display luminance. Information on a low-power voltage EVLSS and an initialization voltage VINT that correspond to each display luminance may be stored in a memory of the display device DD.

Figure 2:
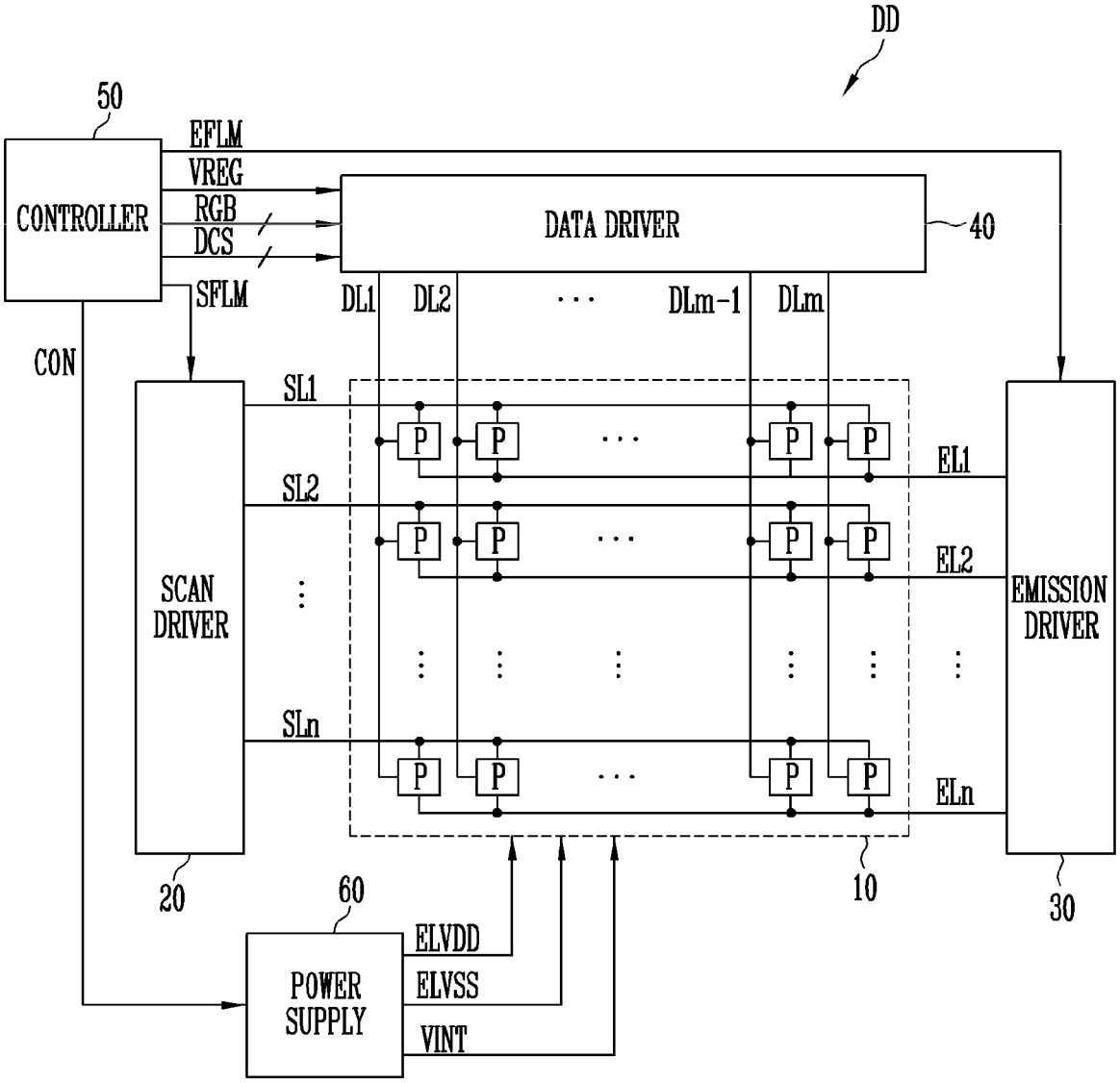
FIG. 2 is a block diagram illustrating a display device according to some exemplary embodiments.

FIG. 2 is a block diagram illustrating a display device according to some exemplary embodiments.

Referring to FIG. 2, the display device DD may include a display panel 10, a scan driver 20, an emission driver 30, a data driver 40, and a controller 50. The display device DD may further include a power supply 60.

The display device DD may be a flat panel display device, a flexible display device, a curved display device, a foldable display device, or a bendable display device. Also, the display device DD may be applied to a transparent display device, a mirror display device, a head-mounted display device, a wearable display device, and the like.

The display panel 10 may include a plurality of scan lines SL1 to SLn, a plurality of emission control lines EL1 to ELn, a plurality of data lines DL1 to DLm, and a plurality of pixels P coupled to the scan lines SL1 to SLn, the emission control lines EL1 to ELn, and the data lines DL1 to DLm (where "n" and "m" are integers of 1 or more). As will become more apparent below, each of the pixels P may include a driving transistor and a plurality of switching transistors.

The scan driver 20 may provide a scan signal to the scan lines SL1 to SLn based on a scan start signal SFLM.

The emission driver 30 may provide an emission control signal to the emission control lines EL1 to ELn based on an emission control start signal EFLM.

The data driver 40 may provide a data voltage to the data lines DL1 to DLn based on a data control signal DCS, image data RGB, and a black gray scale voltage VREG that are provided from the controller 50. For example, the data driver 40 may convert the image data RGB, e.g., digital image data RGB, into an analog data voltage based on the black gray scale voltage VREG.

The black gray scale voltage VREG corresponds to a data voltage at which the display panel 10 displays a black image, and may be an uppermost voltage of the data voltage. The data driver 40 generates a plurality of gray scale voltages by dividing the uppermost voltage of the data voltage so that all gray scales can be expressed with the gray scale voltages.

In some exemplary embodiments, the data driver 40 may include gamma codes with respect to black gray scale voltages VREG. For example, the gamma code may include information on a black gray scale voltage VREG corresponding to a predetermined display luminance and gray scale voltages including the black gray scale voltage VREG.

The controller 50 may control a low-power voltage ELVSS and a black gray scale voltage VREG to be controlled according to display luminances. In some exemplary embodiments, the controller 50 may provide the data driver 40 with a black gray scale voltage VREG corresponding to a current display luminance. In some exemplary embodiments, the controller 50 may provide the data driver 40 with a command corresponding to the black gray scale voltage VREG. The data driver may include a component for generating the black gray scale voltage VREG, and generate the black gray scale voltage VREG corresponding to the command.

In some exemplary embodiments, the controller 50 may output a power control signal CON for controlling the magnitude of the low-power voltage ELVSS. The power supply 60 may control the magnitude of the low-power voltage ELVSS corresponding to a display luminance based on the power control signal CON. Also, the power control signal CON may control the magnitude of an initialization voltage VINT. The initialization voltage VINT may be changed depending on a display luminance.

In some exemplary embodiments, the controller 50 may further include a timing controller that receives an RGB image signal, a vertical synchronization signal, a horizontal synchronization signal, a main clock signal, an enable signal, and the like from an external graphic controller, and generates image data RGB corresponding to the scan start signal SFLM, the emission control start signal EFLM, the data control signal DCS, and the RGB image signal, based on these signals.

In some exemplary embodiments, the data driver 40 and the controller 50 may be implemented with one driver integrated circuit (IC); however, this is merely illustrative. When a plurality of data drivers are utilized, each of a plurality of driver ICs may include the data driver 40, and the controller 50 may separately exist to control the plurality of driver ICs.

In some exemplary embodiments, the controller 50 may include a memory for storing a first black gray scale voltage corresponding to the maximum display luminance and a second black gray scale voltage corresponding to the minimum display luminance, a first calculator (or processor) for determining a value obtained by applying a preset offset to the first black gray scale voltage as a third black gray scale voltage corresponding to a dimming change display luminance, and a second calculator (or processor) for calculating a target black gray scale voltage corresponding to a target display luminance with which the display panel 10 is to emit light by linearly interpolating, with a log scale, a relationship between the dimming change display luminance and the third black gray scale voltage and a relationship between the second display luminance and the second black gray scale voltage. A more detailed configuration and operation of the controller 50 will be described with reference to FIG. 14 and the like.

The power supply 60 may generate a high-power voltage ELVDD, a low-power voltage ELVSS, and an initialization voltage VINT based on the power control signal CON. In some exemplary embodiments, the high-power voltage ELVDD may be a driving voltage supplied to one electrode of the driving transistor of the pixel P, and the low-power voltage ELVSS may be a common voltage supplied to a cathode electrode of an organic light emitting diode of the pixel P. The power supply 60 may generate a low-power voltage ELVSS and an initialization voltage VINT that correspond to the current display luminance in response to a command included in the power control signal CON.

In a light emitting element, e.g., an organic light emitting element included in a pixel P, a bias is changed depending on a change in luminance due to element characteristics. The controller 50 may include information on a low-power voltage ELVSS and an initialization voltage VINT that correspond to each display luminance. Accordingly, light emitting elements can be stably driven even when luminance is changed. The power supply 60 may supply a low-power voltage ELVSS and an initialization voltage VINT to the display panel 10 in connection with a display luminance.

In a conventional display device, a worst case may be computed, and one black gray scale voltage VREG for ensuring a stable operation of a pixel is applied in a lump (or total) with respect to all luminances under any driving condition. However, the swing range (e.g., a voltage difference between a black gray scale voltage and a white gray scale voltage) of a gray scale voltage for expressing all gray scales is widened, and power consumption is increased. In addition, when the swing range of the gray scale voltage is wide, the hysteresis of the driving transistor of the pixel P increases. Therefore, a color shift and/or an afterimage may be viewed when a black luminance is changed to a white luminance or when a low-gray scale image is changed to a high-gray scale image.

In the driving voltage setting device 1000 and the display device DD according to various exemplary embodiments, the black gray scale voltage VREG may be adaptively changed depending on a display luminance. For example, the black gray scale voltage VREG may decrease when the display luminance is lowered. Accordingly, when the display luminance decreases, the swing range of the gray scale voltage is narrowed, and the hysteresis of the driving transistor of the pixel P is reduced. Thus, a black gray scale display defect and an afterimage in a change in image can be remarkably minimized or at least reduced.

Figure 3:
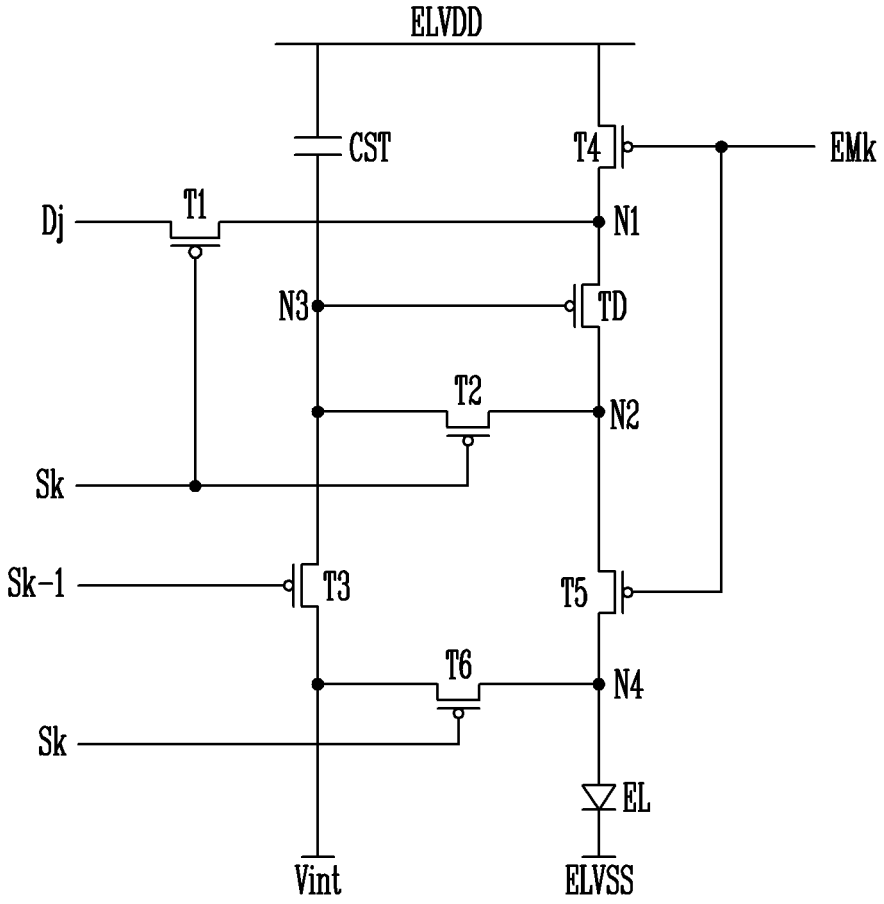
FIG. 3 is a circuit diagram illustrating an example of a pixel of the display device of FIG. 2 according to some exemplary embodiments.
Figure 4:
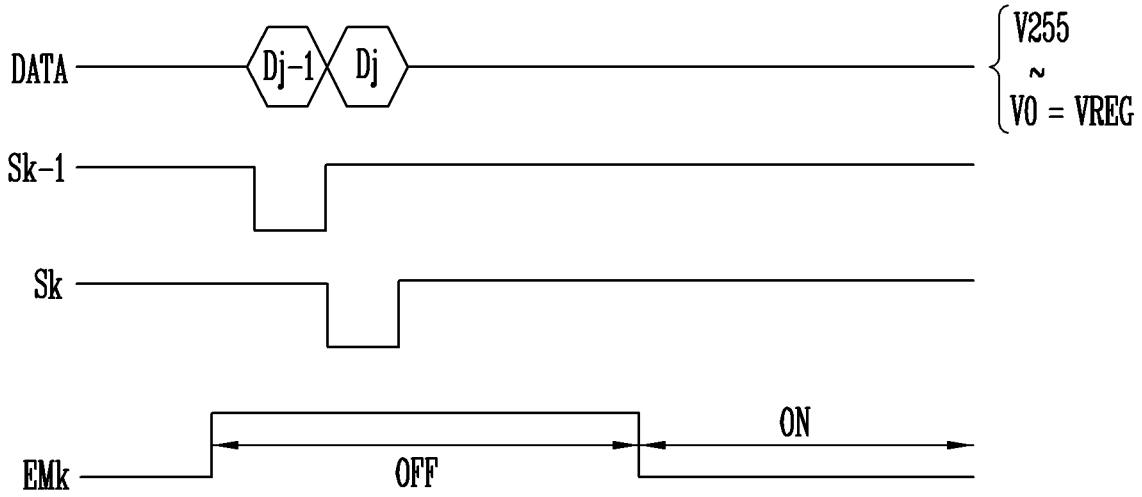
FIG. 4 is a waveform diagram illustrating an example of a driving method of the pixel of FIG. 3 according to some exemplary embodiments.

FIG. 3 is a circuit diagram illustrating an example of a pixel of the display device of FIG. 2 according to some exemplary embodiments. FIG. 4 is a waveform diagram illustrating an example of a driving method of the pixel of FIG. 3 according to some exemplary embodiments.

Referring to FIGS. 3 and 4, the pixel may include a driving transistor TD, first to sixth transistors T1 to T6, an organic light emitting diode EL, and a storage capacitor CST. The pixel of FIG. 3 is described as a (j, k) pixel disposed on a j-th column ("j" being a natural number) and a k-th row ("k" being a natural number greater than 1).

The driving transistor TD may be coupled between a first node N1 and a second node N2. The driving transistor TD may include a gate electrode coupled to a third node N3.

The first transistor T1 is a scan transistor for transferring a data voltage Dj to the pixel by performing scanning of a k-th scan signal Sk. The first transistor T1 may be coupled between a j-th data line and the first node N1. The first transistor T1 may include a gate electrode for receiving the k-th scan signal Sk.

The second transistor T2 may function to write the data voltage Dj to the driving transistor TD and compensate for a threshold voltage of the driving transistor TD. The second transistor T2 may be coupled between the second node N2 and the third node N3. The second transistor T2 may include a gate electrode for receiving the k-th scan signal Sk. When the first transistor T1 and the second transistor T2 are turned on by the k-th scan signal Sk, the driving transistor TD may be diode-coupled, and the threshold voltage of the driving transistor TD may be compensated.

The third transistor T3 may be coupled between a conductive line for transferring an initialization voltage VINT and the third node N3. The third transistor T3 may include a gate electrode for receiving a (k−1)-th scan signal Sk−1. When the third transistor T3 is turned on by the (k−1)-th scan signal Sk−1, the initialization voltage VINT may be supplied to the gate electrode of the driving transistor TD. For example, the initialization voltage VINT may be an initialization voltage for initializing a gate voltage of the driving transistor TD. Therefore, the gate voltage of the driving transistor TD may be initialized to the initialization voltage VINT.

The fourth transistor T4 may be coupled between a power line for transferring a high-power voltage ELVDD and the first node N1. The fourth transistor T4 may include a gate electrode for receiving a k-th emission control signal EMk.

The fifth transistor T5 may be coupled between the second node N2 and an anode N4 of the organic light emitting diode EL. The fifth transistor T5 may include a gate electrode for receiving the k-th emission control signal EMk.

The sixth transistor T6 may be coupled between the conductive line for transferring the initialization voltage VINT and the anode N4 of the organic light emitting diode EL. The sixth transistor T6 may include a gate electrode for receiving the k-th scan signal Sk. When the sixth transistor T6 is turned on by the k-th scan signal Sk, the initialization voltage VINT may be supplied to the anode N4 of the organic light emitting diode EL. Therefore, an anode voltage of the organic light emitting diode EL may be initialized to the initialization voltage VINT. The initialization voltage VINT may be changed depending on a change in luminance of the display panel 10.

The storage capacitor CST may be coupled between the power line for transferring the high-power voltage ELVDD and the third node N3.

A cathode of the organic light emitting diode EL may be coupled to a power line for transferring a low-power voltage ELVSS. The low-power voltage ELVSS may be changed depending on a change in luminance of the display panel 10.

The low-power voltage ELVSS and the initialization voltage VINT may be changed depending on a change in luminance such that the organic light emitting diode EL is driven in a saturation region with respect to each luminance. In some exemplary embodiments, the voltage level of the initialization voltage VINT and the voltage level of the low-power voltage ELVSS may be changed with different rates of change. Accordingly, the magnitude of a forward bias applied to the organic light emitting diode EL can be changed depending on a change in luminance of the display panel 10. In addition, a display defect, such as an unintended increase in black luminance at a low luminance and a low gray scale can be minimized or at least reduced, and a stable black-luminance and low-gray scale display can be implemented.

As shown in FIG. 4, a data voltage DATA may be applied to the pixel when scan signals sequentially have a turn-on level.

A data voltage Dj−1 (or a gray scale voltage) of a previous pixel row may be applied to a data line, and the (k−1)-th scan signal Sk−1 having a turn-on level (e.g., logic low level) may be applied to a (k−1)-th scan line.

The third transistor T3 may be turned on, and an initialization voltage VINT may be applied to the gate electrode of the driving transistor TD.

The (k−1)-th scan signal Sk−1 having a turn-off level (e.g., logic high level) is applied to a k-th scan line. Thus, the first and second transistors T1 and T2 are in a turn-off state, and a gray scale voltage of the previous pixel row can be prevented from being introduced into the pixel.

Subsequently, the data voltage Dj of the current pixel row may be applied to the data line, and the k-th scan signal Sk having a turn-on level may be applied to the k-th scan line. Accordingly, the driving, first, and second transistors TD, T1, and T2 are electrically coupled. The data voltage Dj is transferred to the storage capacitor CST, and the storage capacitor CST stores a quantity of charge, which corresponds to the difference between the high-power voltage ELVDD and the data voltage Dj.

The sixth transistor T6 may be turned on, and the anode voltage of the organic light emitting diode EL may be initialized to the initialized voltage VINT.

The k-th emission control signal EMk may have a turn-off level while overlapping with a section in which the (k−1)-th and k-th scan signals Sk−1 and Sk have the turn-on level.

Subsequently, when the k-th emission control signal EMk having a turn-on level is applied to an emission control line, a driving current corresponding to the quantity of charge stored in the storage capacitor CST may flow into the organic light emitting diode EL through the driving transistor TD. The organic light emitting diode EL may emit light until the k-th emission control signal EMk again has the turn-off level.

In the driving voltage setting device 1000 and the display device DD according to some exemplary embodiments, the black gray scale voltage VREG may be changed depending on an emission luminance (display luminance). In addition, the low-power voltage ELVSS, the initialization voltage VINT, and the off-duty ratio AOR of the k-th emission control signal EMk may be changed depending on the display luminance.

The black gray scale voltage VREG is a reference voltage for determining magnitudes of gray scale voltages. Therefore, gray scale voltages (or data voltages) respectively corresponding to gray scales may be changed by a change in black gray scale voltage VREG depending on the display luminance. In addition, the display luminance may be changed by adjusting the off-duty ratio AOR of the k-th emission control signal EMk in a predetermined luminance range.

Figure 5:
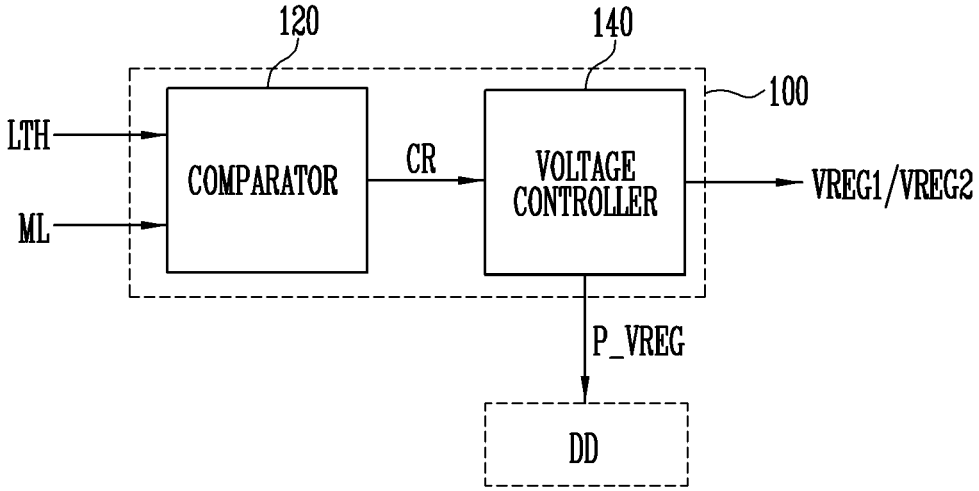
FIG. 5 is a block diagram illustrating an example of a first voltage determiner of the driving voltage setting device of FIG. 1 according to some exemplary embodiments.

FIG. 5 is a block diagram illustrating an example of a first voltage determiner of the driving voltage setting device of FIG. 1 according to some exemplary embodiments.

Referring to FIGS. 1 and 5, the first voltage determiner 100 may include a comparator 120 and a voltage controller 140.

The first voltage determiner 100 may determine a first black gray scale voltage VREG1 and a second black gray scale voltage VREG2. The first black gray scale voltage VREG1 is the maximum black gray scale voltage applied to the display device DD, and may be a black gray scale voltage corresponding to the maximum luminance with which the display device DD emits light. The second black gray scale voltage VREG1 is the minimum black gray scale voltage applied to the display device DD, and may be a black gray scale voltage corresponding to the minimum luminance with which the display device DD emits light.

In some exemplary embodiments, the display device DD may emit light based on a preliminary black gray scale voltage P_VREG and a predetermined display luminance condition. The luminance measurer 300 may measure a luminance of the display device DD and provide the measured luminance ML to the comparator 120.

In some exemplary embodiments, the first voltage determiner 100 may determine a first black gray scale voltage VREG1 and a second black gray scale voltage VREG2 respectively under a first display luminance condition and a second display luminance condition. The first black gray scale voltage VREG1 determined under the first display luminance condition may be a black gray scale voltage corresponding to the maximum luminance. The second black gray scale voltage VREG2 determined under the second display luminance condition may be a black gray scale voltage corresponding to the minimum luminance.

In some exemplary embodiments, the first display luminance condition may include information on a low-power voltage EVLSS, an initialization voltage VINT, and an off-duty ratio AOR that correspond to the maximum luminance, and the second display luminance condition may include information on a low-power voltage EVLSS, an initialization voltage VINT, and an off-duty ratio AOR that correspond to the minimum luminance.

The comparator 120 may compare the measured luminance ML provided from the luminance measurer 300 with a threshold black luminance LTH, which may be preset or otherwise predetermined. The threshold black luminance LTH may become a reference for determining whether a corresponding display device can sufficiently output a black gray scale. For example, the threshold black luminance LTH may be set to about 0.005 nit. However, this is merely illustrative, and the threshold black luminance LTH may be set to another value depending on a product.

The comparator 120 may provide the voltage controller 140 with a comparison result CR between the measured luminance ML and the threshold black luminance LTH.

When the measured luminance ML is the threshold black luminance LTH or less, the voltage controller 140 may decrease the preliminary black gray scale voltage P_VREG. In some exemplary embodiments, the voltage controller 140 may set a new preliminary black gray scale voltage P_VREG by applying a predetermined decrease offset to the preliminary black gray scale voltage P_VREG. The new preliminary black gray scale voltage P_VREG may be again provided to the display device DD.

A measured luminance ML caused by the new preliminary black gray scale voltage P_VREG may be again provided to the comparator 120. The comparator 120 and the voltage controller 140 may repeat the above-described operation.

When the measured luminance ML is larger than the threshold black luminance LTH, the voltage controller 140 may set, as the first black gray scale voltage VREG1 or the second black gray scale voltage VREG2, a value obtained by applying a predetermined margin to the preliminary black gray scale voltage P_VREG. For example, when the first display luminance condition is applied to the display device DD, a finally calculated black gray scale voltage may be determined as the first black gray scale voltage VREG1 applied to the maximum luminance. In addition, when the second display luminance condition is applied to the display device DD, a finally calculated black gray scale voltage may be determined as the second black gray scale voltage VREG2 applied to the minimum luminance.

As described above, the first voltage determiner 100 repeatedly measures luminances of an individual display device DD to calculate the first black gray scale voltage VREG1 applied to the maximum luminance and the second black gray scale voltage VREG2 applied to the minimum luminance.

Figure 6:
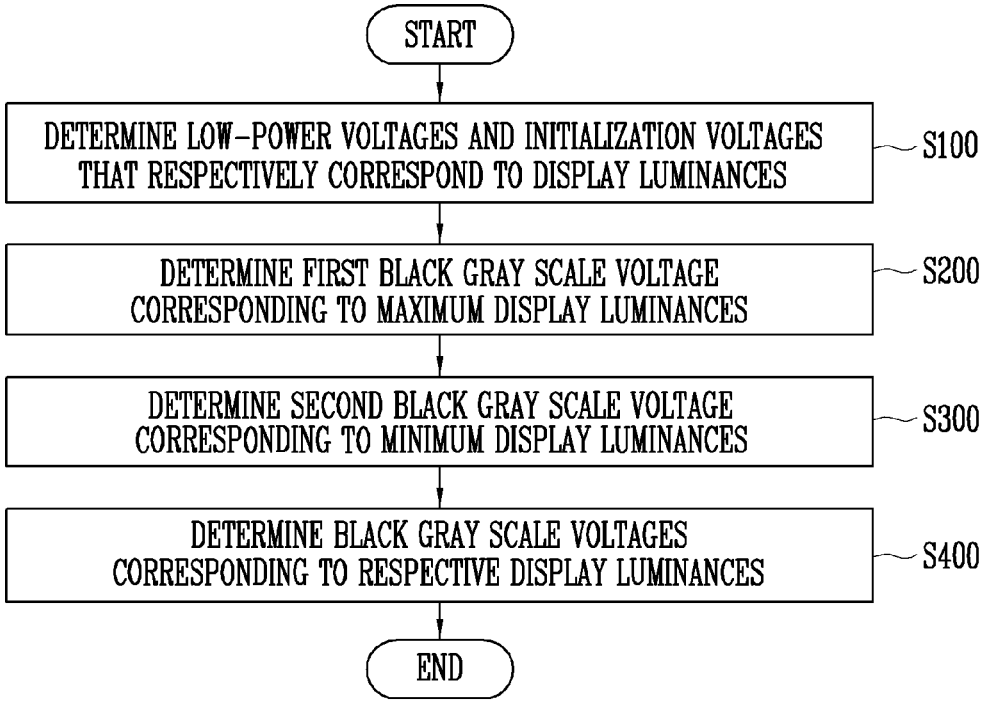
FIG. 6 is a flowchart illustrating a method of setting a driving voltage for the display device according to some exemplary embodiments.

FIG. 6 is a flowchart illustrating a method of setting a driving voltage for the display device according to some exemplary embodiments.

Referring to FIGS. 1 and 6, the method may include a step (S100) of determining low-power voltages ELVSS (e.g., a common driving voltage) and initialization voltages VINT that respectively correspond to preset display luminances such that light emitting elements included in the display device DD are driven in a saturation region with respect to the respective display luminances, a step (S200) of determining a first black gray scale voltage VREG1 corresponding a maximum display luminance of the display device DD based on a variable preliminary black gray scale voltage P_VREG under a maximum luminance condition, a step (S300) of determining a second black gray scale voltage VREG2 corresponding a minimum display luminance of the display device DD based on the preliminary black gray scale voltage P_VREG under a minimum luminance condition, and a step (S400) of determining black gray scale voltages corresponding to the respective display luminances except the maximum display luminance and the minimum display luminance based on the first black gray scale voltage VREG1 and the second black gray scale voltage VREG2.

The low-power voltages ELVSS and the initialization voltages VINT that respectively correspond to preset display luminances may be determined such that light emitting elements included in the display device DD are driven in the saturation region with respect to the respective display luminances (S100). The low-power voltage ELVSS may be a common voltage supplied to the cathode of the organic light emitting diode EL included in the pixel P, and the initialization voltage VINT may be a voltage for initializing the anode voltage of the organic light emitting diode EL.

The low-power voltages ELVSS and the initialization voltages VINT may be determined through various setting modes known in the art. In some exemplary embodiments, data including a relationship between a display luminance and the low-power voltages EVLSS and initialization voltages VINT may be stored in the memory of the display device DD. The low-power voltages ELVSS and the initialization voltages VINT may be determined as different values for each display device DD according to a configuration characteristic of each of the display devices DD.

A first black gray scale voltage VREG1 corresponding to a maximum display luminance of the display device DD may be determined based on a variable preliminary black gray scale voltage P_VREG under a maximum luminance condition (S200). For example, the first black gray scale voltage VREG1 may be a black gray scale voltage applied to a display luminance of about 750 nit. All gray scale voltages applied to the maximum display luminance may be calculated based on the first black gray scale voltage VREG1.

A second black gray scale voltage VREG2 corresponding to a minimum display luminance of the display device DD may be determined based on the preliminary black gray scale voltage P_VREG under a minimum display luminance condition (S300). For example, the second black gray scale voltage VREG2 may be a black gray scale voltage applied to a display luminance of about 2 nit. The second black gray scale voltage VREG2 cannot be larger than the first black gray scale voltage VREG1.

Black gray scale voltages corresponding to the respective display luminances, except the maximum display luminance and the minimum display luminance, may be determined based on the first black gray scale voltage VREG1 and the second black gray scale voltage VREG2 (S400). In some exemplary embodiments, a black gray scale voltage applied to a predetermined display luminance may be calculated by linearly interpolating between (or based on) the first black gray scale voltage VREG1 and the second black gray scale voltage VREG2. In some exemplary embodiments, the magnitude of the black gray scale voltage may decrease when the display luminance decreases.

The steps S200 to S400 will be described in more detail with reference to FIGS. 7 to 11, 12A, and 12B.

Figure 7:
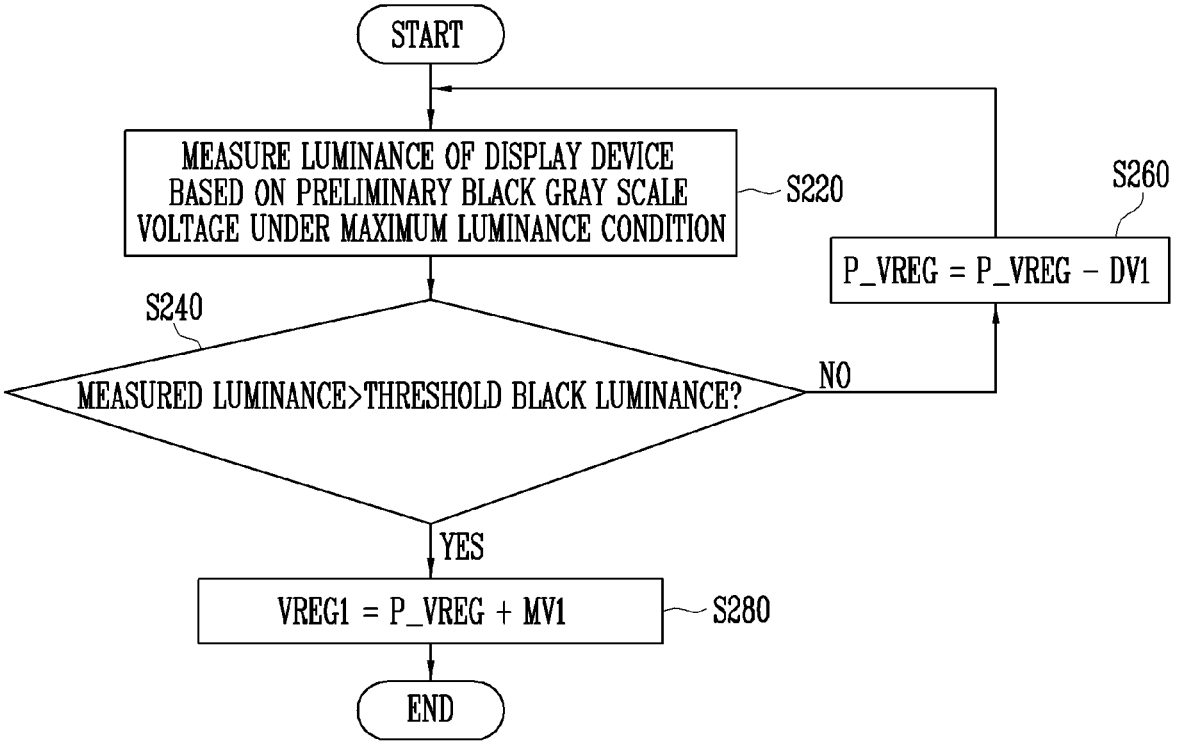
FIG. 7 is a flowchart illustrating an example of determining a first black gray scale voltage included in the method of FIG. 6 according to some exemplary embodiments.
Figures 8, 9:
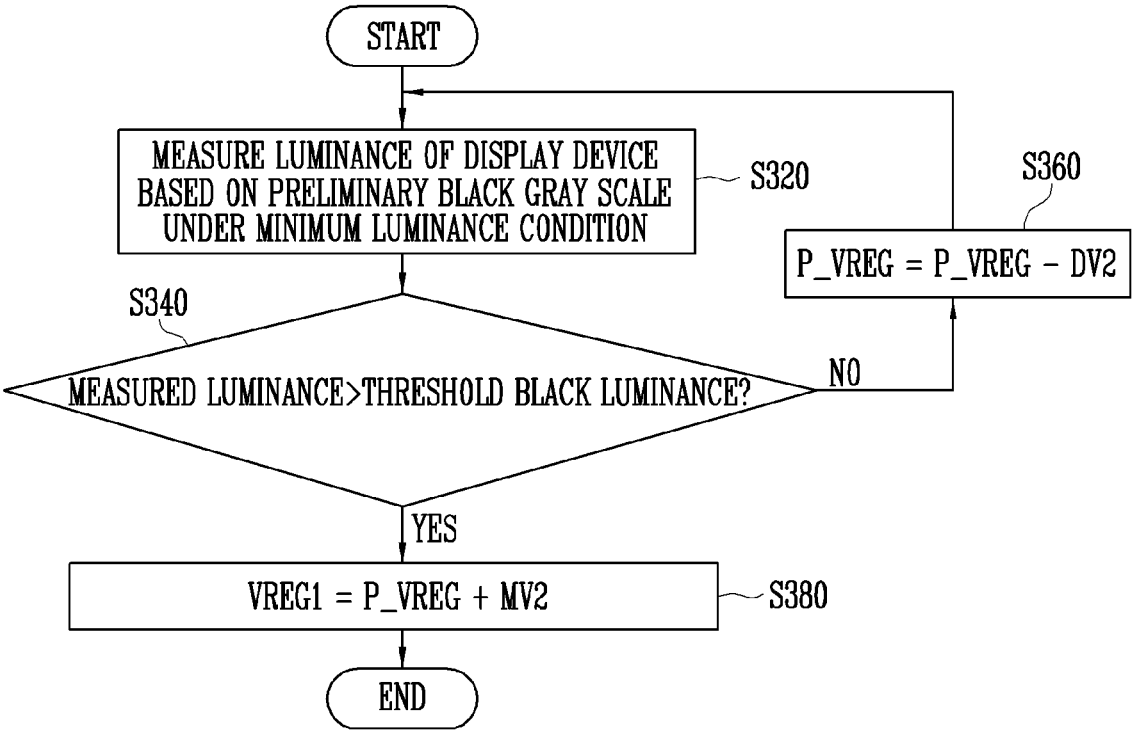
FIG. 8 is a diagram illustrating an example of determining the first black gray scale voltage shown in FIG. 7 according to some exemplary embodiments.
FIG. 9 is a flowchart illustrating an example of determining a second black gray scale voltage included in the method of FIG. 6 according to some exemplary embodiments.

FIG. 7 is a flowchart illustrating an example of determining a first black gray scale voltage included in the method of FIG. 6 according to some exemplary embodiments. FIG. 8 is a diagram illustrating an example of determining the first black gray scale voltage shown in FIG. 7 according to some exemplary embodiments.

Referring to FIGS. 1 and 5 to 8, the step of determining the first black gray scale voltage VREG1 may include a step (S220) of measuring a luminance of the display device DD based on the a preliminary black gray scale voltage P_VREG under a maximum luminance condition, a step (S240) of comparing the measured luminance ML with a preset threshold black luminance LTH, a step (S260) of decreasing a preliminary black gray scale voltage P_VREG corresponding to the measured luminance ML when the measured luminance ML is the threshold black luminance LTH or less, and a step (S280) of determining, as the first black gray scale voltage VREG1, a value obtained by applying a first margin MV1 to the preliminary black gray scale voltage P_VREG corresponding to the measured luminance ML.

A luminance of the display device DD may be measured based on a preliminary black gray scale voltage P_VREG under a maximum luminance condition (S220). The maximum luminance condition may be information on a low-power voltage ELVSS, an initialization voltage VINT, and an off-duty ratio AOR that are applied when the display device DD displays a maximum luminance. For example, when the maximum luminance is about 750 nit, as shown in the following Table 1, the low-power voltage ELVSS may be determined as about −3.6V, the initialization voltage VINT may be determined as about −4.4V, and the off-duty ratio AOR may be determined as about 2.9%.

TABLE 1

| | AOR | ELVSS | VINT |
|---|---|---|---|
| Maximum Luminance Condition | 2.9% | −3.6 V | −4.4 V |

The off-duty ratio AOR may be a ratio of a turn-on section to a turn-off section of a k-th emission control signal EMk in one frame.

In addition, an initial preliminary black gray scale voltage P_VREG may be set to about 6.7V.

The maximum luminance condition and the preliminary black gray scale voltage P_VREG may be provided to the display device DD. The display device DD may output a black luminance under the maximum luminance condition. That is, the display device DD may output a black luminance in a worst case. The luminance measurer 300 may measure a luminance of the display device DD and output the measured luminance ML. The measured luminance ML may be a measured black luminance.

The measured luminance ML and a threshold black luminance LTH may be compared by the comparator 120 (S240). For example, the threshold black luminance LTH may be set to about 0.005 nit.

When the measured luminance ML is the threshold black luminance LTH or less, the preliminary black gray scale voltage P_VREG may be decreased (S260). That is, this is a process of determining whether a normal black luminance can be output even at a voltage lower than a previously set preliminary black gray scale voltage P_VREG. In some exemplary embodiments, a new preliminary black gray scale voltage P_VREG may be determined by subtracting a preset subtraction value DV1 from the preliminary black gray scale voltage P_VREG. In an example, the subtraction value DV1 may be about 0.1 V. The measured luminance ML and the threshold black luminance LTH may be compared by decreasing the preliminary black gray scale voltage P_VREG by 0.1 V.

The new preliminary black gray scale voltage P_VREG may be again provided to the display device DD. As such, the steps S220 to S260 may be repeated until the measured luminance ML exceeds the threshold black luminance LTH.

When the measured luminance ML is larger than the threshold black luminance LTH, a voltage obtained by applying a first margin MV1 to the preliminary black gray scale voltage P_VREG corresponding to the measured luminance ML may be determined as the first black gray scale voltage VREG1.

The first margin MV1 is a value for reflecting a change in characteristic of the pixel P depending on a change in temperature, a measurement error of the measured luminance ML, a variation in the comparison result CR, and the like. The first margin MV1 is a value set to consider reliability. For example, the first margin MV1 may be set to about 0.2 V. However, this is merely illustrative, and the first margin MV1 may be 0 or any other suitable value.

In some exemplary embodiments, the first black gray scale voltage VREG1 may be a black gray scale voltage applied to the maximum display luminance.

An operation of calculating the first black gray scale voltage VREG1 may be shown in FIG. 8. For example, a luminance of the display device DD may be measured when the preliminary black gray scale voltage P_VREG is decreased by 0.1 V from about 6.7 V. As shown in FIG. 8, when the preliminary black gray scale voltage P_VREG is 6.0 V, the measured luminance ML is about 0.0084 nit, which exceeds the threshold black luminance LTH. As such, 6.1 V obtained by applying a first margin MV1 to 6.0 V may be determined as the first black gray scale voltage VREG1. The first margin MV1 may be set to 0.1 V.

FIG. 9 is a flowchart illustrating an example of determining a second black gray scale voltage included in the method of FIG. 6 according to some exemplary embodiments. FIG. 10 is a diagram illustrating an example of determining the second black gray scale voltage shown in FIG. 9 according to some exemplary embodiments.

The step of determining the second black gray scale voltage VREG2, which is shown in FIGS. 9 and 10, is identical to the step of determining the first black gray scale voltage VREG1, which is shown in FIGS. 7 and 8, and therefore, overlapping descriptions will be omitted.

Referring to FIGS. 1 and 5 to 10, the step of determining the second black gray scale voltage VREG2 may include a step (S320) of measuring a luminance of display device DD based on the preliminary black gray scale voltage P_VREG under a minimum luminance condition, a step (S340) of comparing the measured luminance ML with a preset threshold black luminance LTH, a step (S360) of decreasing a preliminary black gray scale voltage P_VREG corresponding to the measured luminance ML when the measured luminance ML is the threshold black luminance LTH or less, and a step (S380) of determining, as the second black gray scale voltage VREG2, a value obtained by applying a second margin MV2 to the preliminary black gray scale voltage P_VREG corresponding to the measured luminance ML.

The minimum luminance condition may be information on a low-power voltage ELVSS, an initialization voltage VINT, and an off-duty ratio AOR that are applied when the display device DD displays a minimum luminance. For example, when the minimum luminance is about 2 nit, as shown in the following Table 2, the low-power voltage ELVSS may be determined as about 3.1V, the initialization voltage VINT may be determined as about −3.3V, and the off-duty ratio AOR may be determined as about 98.1%.

TABLE 2

| | AOR | ELVSS | VINT |
|---|---|---|---|
| Minimum Luminance Condition | 98.1% | 3.1 V | −3.3 V |

An initial preliminary black gray scale voltage P_VREG may be set to about 6.7V.

The display device DD may output a black luminance under the minimum luminance condition. That is, the measured luminance ML may be a black luminance measured by the luminance measurer 300.

When the measured luminance ML is the threshold black luminance LTH, the preliminary black gray scale voltage P_VREG corresponding to the measured luminance ML may be decreased (S260). For example, the measured luminance ML and the threshold black luminance LTH may be compared by decreasing the preliminary black gray scale voltage P_VREG by 0.1 V. As such, the steps S320 to S360 may be repeated until the measured luminance ML exceeds the threshold black luminance LTH.

When the measured luminance ML is larger than the threshold black luminance LTH, a value obtained by applying a second margin MV2 to the preliminary black gray scale voltage P_VREG corresponding to the measured luminance ML may be determined as the second black gray scale voltage VREG2 (S380).

As shown in FIG. 10, when the preliminary black gray scale voltage P_VREG is 5.1 V under the minimum display luminance condition, the measured luminance ML is about 0.0075 nit, which exceeds the threshold black luminance LTH. Therefore, 5.2 V obtained by applying a second margin MV2 to 5.1 V may be determined as the second black gray scale voltage VREG2. The second margin MV2 may be equal to or different from the first margin MV1.

Black gray scale voltages with respect to the other display luminances cannot be out of the range between the first and second black gray scale voltages VREG1 and VREG2.

Figure 11:
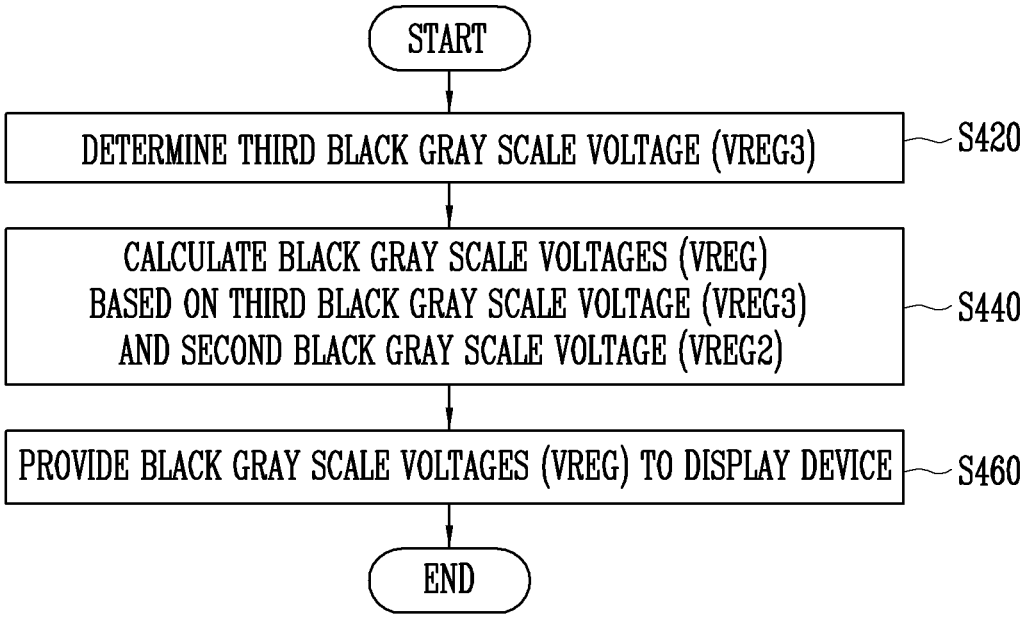
FIG. 11 is a flowchart illustrating an example of determining black gray scale voltages included in the method of FIG. 6 according to some exemplary embodiments.
Figure 12A:
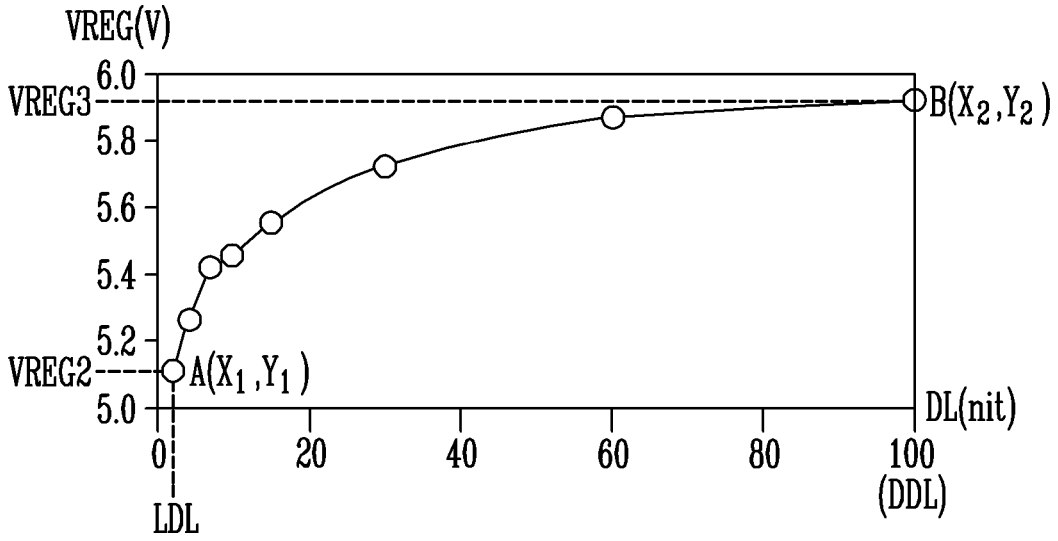
FIGS. 12A and 12B are graphs illustrating examples of black gray scale voltage with respect to display luminance according to some exemplary embodiments.
Figure 12B:
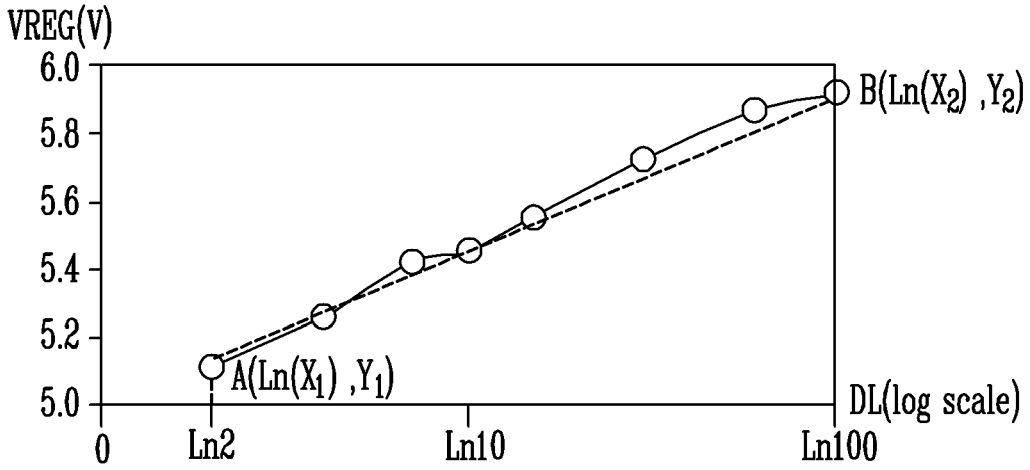

FIG. 11 is a flowchart illustrating an example of determining black gray scale voltages included in the method of FIG. 6 according to some exemplary embodiments. FIGS. 12A and 12B are graphs illustrating examples of black gray scale voltage with respect to display luminance according to some exemplary embodiments.

Referring to FIGS. 1 and 5 to 11, 12A, and 12B, the step of determining the black gray scale voltages may include a step (S420) of determining a value obtained by applying a preset offset to the first black gray scale voltage VREG1 as a third black gray scale voltage VREG3 corresponding to a dimming change display luminance DDL, a step (S440) of calculating black gray scale voltages VREG corresponding to display luminances DL between a minimum display luminance LDL and the dimming change display luminance DDL by linearly interpolating, with a log scale, a relationship between the dimming change display luminance DDL and the third black gray scale voltage VREG3 and a relationship between the minimum display luminance LDL and the second black gray scale voltage VREG2, and a step (S460) of providing the display device DD with black gray scale voltages VREG including the first and second black gray scale voltages VREG1 and VREG2.

A value obtained by applying a preset offset to the first black gray scale value VREG1 may be determined as a third black gray scale voltage VREG3 corresponding to a dimming change display luminance DDL (S420). The dimming change display luminance DDL may correspond to a reference where the dimming mode of the display DD is changed among display luminances DL. A gamma dimming mode may be applied to the display device DD with respect to a luminance higher than the dimming change display luminance DDL, and an off-duty ratio adjustment dimming mode may be applied to the display device DD with respect to a luminance lower than the dimming change display luminance DDL. In some exemplary embodiments, any one of the two dimming modes may be applied with respect to the dimming change display luminance DDL.

For example, the maximum display luminance (or first display luminance) may be about 750 nit, and the dimming change display luminance DDL may be about 100 nit. When the first black gray scale value VREG1 is 6.1 V, the third black gray scale voltage VREG3 may be about 6.0 V. That is, the offset may be 0.1 V. For example, a black gray scale voltage VREG may be maintained as about 6.1 V or be linearly decreased from 6.1 V to 6.0 V in a luminance section corresponding to a gamma dimming section. However, this is merely illustrative, and the offset is not limited thereto. For example, the offset may be 0 V, and the first black gray scale voltage VREG1 may be constantly maintained in the gamma dimming section.

Black gray scale voltages VREG corresponding to display luminances between the minimum display luminance LDL and the dimming change display luminance DDL may be calculated. A black gray scale voltage VREG with respect to each of all display luminances may be individually set. That is, the magnitude of the black gray scale voltage VREG may be adjusted in connection with a display luminance.

FIG. 12A illustrates optimum black gray scale voltage VREG for each display luminance DL through luminance measurement of the display device DD according to some exemplary embodiments. For example, the luminance measurement may be performed on representative display luminances defined as 2 nit, 4 nit, 7 nit, 10 nit, 15 nit, 30 nit, 60 nit, and 100 nit. A luminance section between 0 and 100 nit is a section to which the off-duty ratio adjustment dimming mode is applied. That is, as shown in FIG. 12A, the relation between the display luminance DL and the black gray scale voltage VREG may be provided in the form of an exponential function.

In some exemplary embodiments, the black gray scale voltage VREG may be adaptively changed by an algorithm to which an exponential function of FIG. 12A is applied depending on all display luminances DL.

In some exemplary embodiments, black gray scale voltages VREG may be calculated by interpolating the second black gray scale voltage VREG2 and the third black gray scale voltage VREG3. For example, black gray scale voltages VREG respectively corresponding to display luminances DL may be determined by converting the display luminances DL with a log scale and linearly interpolating the second black gray scale voltage VREG2 and the third black gray scale voltage VREG3.

As shown in FIG. 12B, black gray scale voltages VREG with respect to display luminances DL between the minimum display luminance LDL and the dimming change display luminance DDL may be calculated based on a slope between point A and point B of the graph in which the display luminances DL are converted with a log scale.

For example, black gray scale voltage VREG y with respect to display luminance x may be calculated by the following Equation 1:

$$Y2-y=S*(\mathrm{Ln}(X2)-\mathrm{Ln}(x)) \quad \text{Equation 1}$$

Y2 may be a third black gray scale voltage VREG3, S may be a slope, and X2 may be a dimming change display luminance DDL. In addition, the slope S may be expressed by the following Equation 2:

$$S=(Y2-Y1)/(\mathrm{Ln}(X2)-\mathrm{Ln}(X1)) \quad \text{Equation 2}$$

Y1 may be a second black gray scale voltage VREG2, and X1 may be a minimum display luminance LDL.

Therefore, as shown in FIG. 12B, the black gray scale voltage VREG may have an approximately linear relationship with the display luminance DL converted with the log scale. When a predetermined display luminance DL is input to Equation 1, a black gray scale voltage VREG corresponding to the display luminance DL may be calculated.

However, this is merely illustrative, and the method of calculating black gray scale voltages VREG with respect to the respective display luminances DL between the minimum luminance LDL and the dimming change display luminance DDL is not limited thereto. The black gray scale voltages VREG may be calculated as an algorithm or hardware by various calculation methods known in the art.

In some exemplary embodiments, the black gray scale voltage VREG may decrease when the display luminance DL decreases in the off-duty ratio adjustment section. However, this is merely illustrative, and a change in black gray scale voltage VREG is not limited thereto. For example, when the display luminance DL increases, the black gray scale voltage VREG may increase in the form of a step function.

Data in which black gray scale voltages VREG with respect to all display luminances DL are set may be provided (recorded) to (in) the display device DD (S460). In some exemplary embodiments, the driving voltage setting device 1000 of FIG. 1 may provide (record), to (in) the display device DD, data in which black gray scale voltages VREG with respect to all display luminances DL are set through the above-described procedure. The display device DD may store the data, using the memory, etc., and display an image by changing a black gray scale voltage VREG depending on a display luminance DL.

As described above, in the driving voltage setting device 1000 and the display device DD according to various exemplary embodiments, a black gray scale voltage VREG corresponding to a display luminance DL can be adaptively changed using the second and third black gray scale voltages VREG2 and VREG3 obtained through luminance measurement. As such, as the display luminance DL decreases, the swing range of a gray scale voltage can be narrowed, and the hysteresis of the driving transistor can be reduced. Thus, a black gray scale display defect at a low luminance and an afterimage viewed in a change in image can be minimized.

Figures 13, 14:
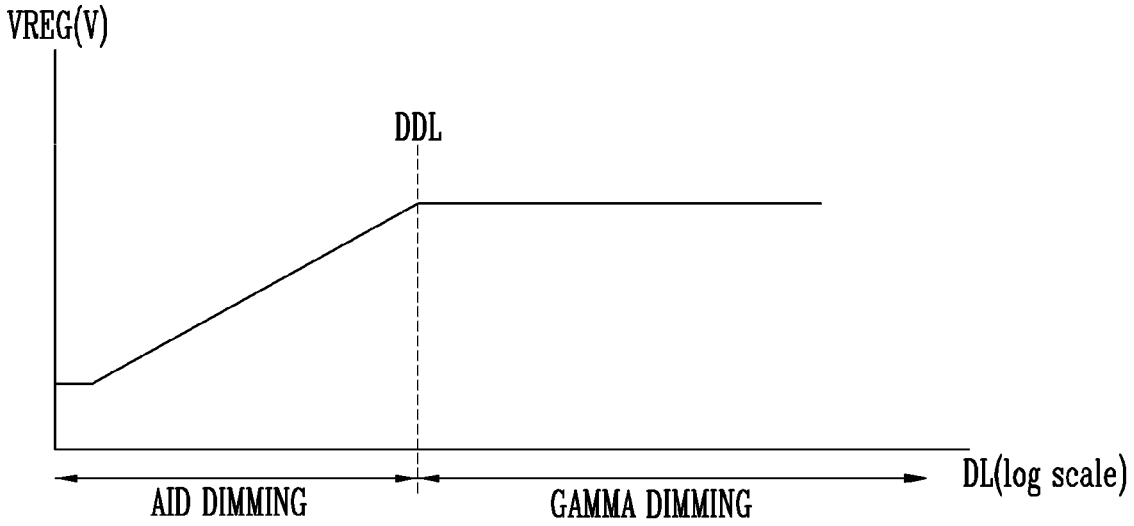
FIG. 13 is a graph illustrating an example of black gray scale voltage with respect to display luminance according to some exemplary embodiments.
FIG. 14 is a diagram illustrating an example of setting a dimming mode and a black gray scale voltage according to display luminance of a display device according to some exemplary embodiments.

FIG. 13 is a graph illustrating an example of black gray scale voltage with respect to display luminance according to some exemplary embodiments. FIG. 14 is a diagram illustrating an example of setting a dimming mode and a black gray scale voltage according to display luminance of a display device according to some exemplary embodiments.

Referring to FIGS. 13 and 14, a black gray scale voltage VREG may have different values depending on a display luminance DL and a dimming mode.

The dimming mode of the display device DD is changed based on a dimming change display luminance DDL. When the display luminance DL is larger than the dimming change display luminance DDL, a gamma dimming mode may be applied. For example, the black gray scale voltage VREG may be uniform as the first black gray scale voltage VREG1 (e.g., 6.1 V) in a high-luminance section of 101 nit to 750 nit. The off-duty ratio AOR of a k-th emission control signal EMk is not changed in a gamma dimming section GAMMA DIMMING.

In some exemplary embodiments, the third black gray scale voltage VREG3 obtained by applying a predetermined offset to the first black gray scale voltage VREG1 may be applied to the display device DD with respect to the dimming change display luminance DDL.

In some exemplary embodiments, the black gray scale voltage VREG may be adjusted according to a change in display luminance DL based on the difference between the second black gray scale voltage VREG2 and the third black gray scale voltage VREG3 in an off-duty ratio adjustment section AID DIMMING. For example, when the display luminance DL decreases, the black gray scale voltage VREG may decrease through the method of calculating the black gray scale voltage VREG, which is shown in FIG. 13.

Figure 15:
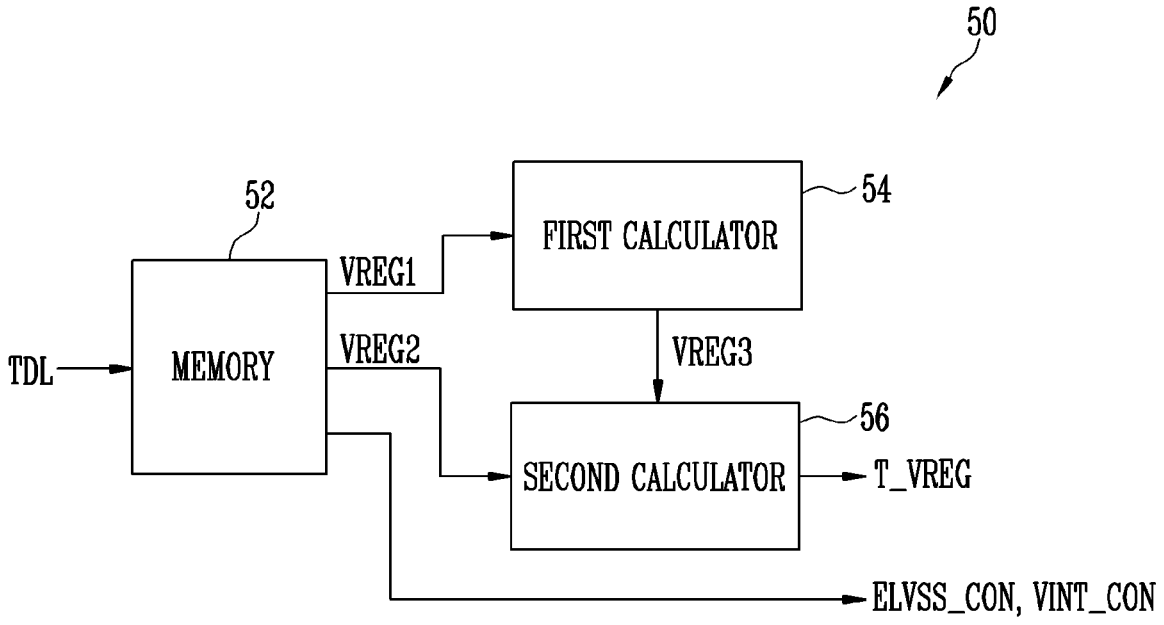
FIG. 15 is a block diagram illustrating an example of a controller of the display device of FIG. 2 according to some exemplary embodiments.

FIG. 15 is a block diagram illustrating an example of a controller of the display device of FIG. 2 according to some exemplary embodiments.

Referring to FIGS. 3 and 15, the controller 50 may include a memory 52, a first calculator 54, and a second calculator 56.

The memory 52 may store a first black gray scale voltage VREG1 applied to a maximum display luminance and a second black gray scale voltage VREG2 applied to a minimum display luminance. For example, the first and second black gray scale voltages VREG1 and VREG2 may be generated by the driving voltage setting device 1000 of FIG. 1 to be recorded in the memory 52. The memory 52 may receive information on a target display luminance TDL with which the display panel 10 is to emit light. The memory 52 may read the first black gray scale voltage VREG1 and the second black gray scale voltage VREG2, based on the target display luminance TDL. The first black gray scale voltage VREG1 may be provided to the first calculator 54, and the second black gray scale voltage VREG2 may be provided to the second calculator 56.

In some exemplary embodiments, the memory 52 may include information on low-power voltages ELVSS respectively corresponding to display luminances and information on initialization voltages VINT respectively corresponding to the display luminances DL. The memory 52 may provide the power supply 60 with a low-power voltage command ELVSS_CON including information on a low-power voltage ELVSS applied to the target display luminance TDL. Also, the memory 52 may provide the power supply 60 with an initialization voltage command VINT_CON including information on an initialization voltage VINT applied to the target display luminance TDL.

The power supply 60 may generate a low-power voltage ELVSS and an initialization voltage VINT that are applied to the target display luminance TDL in response to the low-power voltage command ELVSS_CON and the initialization voltage command VINT_CON.

The first calculator 54 may determine a value obtained by applying a preset offset to the first black gray scale voltage VREG1 as a third black gray scale voltage VREG3 applied to a dimming change display luminance DDL.

The second calculator 56 may calculate a target black gray scale voltage T_VREG applied to the target display luminance TDL by interpolating a relationship between the dimming change display luminance DDL and the third black gray scale voltage VREG3 and a relationship between the minimum display luminance and the second black gray scale voltage VREG2. In some exemplary embodiments, the second calculator 56 may perform the interpolation by converting display luminances DL with a log scale.

The method of calculating the target black gray scale voltage T_VREG has been described with reference to FIGS. 11 to 12B, and therefore, overlapping descriptions will be omitted.

In some exemplary embodiments, the memory 52 may include all information on black gray scale voltages respectively corresponding to display luminances DL. The size of the memory 52 may increase, but the first and second calculators 54 and 56 may be omitted.

As described above, in the display device DD according to various exemplary embodiments, a black gray scale voltage VREG corresponding to a display luminance DL can be adaptively changed using the second and third black gray scale voltages VREG2 and VREG3. Accordingly, as the display luminance DL decreases, the swing range of a gray scale voltage VREG can be narrowed, and the hysteresis of the driving transistor can be reduced. Thus, a black gray scale display defect at a low luminance and an afterimage viewed in a change in image can be minimized.

In the driving voltage setting device 1000 and the method according to various exemplary embodiments, a black gray scale voltage VREG may be adaptively changed depending on a display luminance DL. For example, the black gray scale voltage VREG may decrease when the display luminance DL is lowered. Accordingly, when the display luminance DL decreases, the swing range of the black gray scale voltage VREG is narrowed, and the hysteresis of the driving transistor is reduced. Thus, a black gray scale display defect and an after image in a change in image can be remarkably minimized.

Further, in the display device DD according to various exemplary embodiments, a black gray scale voltage VREG is adaptively decreased corresponding to a decrease in display luminance DL so that an afterimage in a change in image and a black gray scale display defect at a low luminance can be minimized.

Although certain exemplary embodiments and implementations have been described herein, other embodiments and modifications will be apparent from this description. Accordingly, the inventive concepts are not limited to such embodiments, but rather to the broader scope of the accompanying claims and various obvious modifications and equivalent arrangements as would be apparent to one of ordinary skill in the art.

What is claimed is:

1. A driving voltage setting device, comprising:

a first voltage determiner configured to:

determine, based on a variable preliminary black gray scale voltage under a first display luminance condition, a first black gray scale voltage corresponding to a first display luminance of a display device; and determine, based on the variable preliminary black gray scale voltage under a second display luminance condition, a second black gray scale voltage corresponding to a second display luminance of the display device;

a luminance measurer configured to measure a luminance of a black gray scale of the display device using the variable preliminary black gray scale voltage; and a second voltage determiner configured to determine, based on the first black gray scale voltage and the second black gray scale voltage, black gray scale voltages respectively corresponding to a plurality of preset display luminances between the first display luminance and the second display luminance.

2. The driving voltage setting device of claim 1, wherein:

the first black gray scale voltage is a largest black gray scale voltage among the black gray scale voltages applied to the display device; and the second black gray scale voltage is a smallest black gray scale voltage among the black gray scale voltages applied to the display device.

3. The driving voltage setting device of claim 1, wherein:

the first display luminance is a maximum luminance at which the display device emits light; and the second display luminance is a minimum luminance at which the display device emits light.

4. The driving voltage setting device of claim 3, wherein:

the first display luminance condition comprises information on a low-power voltage, an initialization voltage, and an off-duty ratio that correspond to the maximum luminance; and the second display luminance condition comprises information on a low-power voltage, an initialization voltage, and an off-duty ratio that correspond to the minimum luminance.

5. The driving voltage setting device of claim 4, wherein:

the low-power voltage is a voltage provided to a cathode of a light emitting element of the display device; and the initialization voltage is a voltage to initialize an anode voltage of the light emitting element.

6. The driving voltage setting device of claim 3, wherein the first voltage determiner comprises:

a comparator configured to compare a measured luminance provided from the luminance measurer with a preset threshold black luminance; and a voltage controller configured to decrease the variable preliminary black gray scale voltage corresponding to the measured luminance in response to the measured luminance being less than or equal to the threshold black luminance.

7. The driving voltage setting device of claim 6, wherein, in response to the measured luminance being greater than the threshold black luminance under the first display luminance condition, the voltage controller is configured to determine, as the first black gray scale voltage, a value obtained by applying a first margin to the variable preliminary black gray scale voltage corresponding to the measured luminance.

8. The driving voltage setting device of claim 6, wherein, in response to the measured luminance being greater than the threshold black luminance under the second display luminance condition, the voltage controller is configured to determine, as the second black gray scale voltage, a value obtained by applying a second margin to the variable preliminary black gray scale voltage corresponding to the measured luminance.

9. The driving voltage setting device of claim 3, wherein:

the second voltage determiner is configured to determine, as a third black gray scale voltage, a value obtained by applying a preset offset to the first black gray scale voltage; and the third black gray scale voltage corresponds to a dimming change display luminance, which is a reference at which a dimming mode of the display device is changed among the display luminances.

10. The driving voltage setting device of claim 9, wherein the second voltage determiner is configured to determine the black gray scale voltages corresponding to the display luminances between the second display luminance and the dimming change display luminance by linearly interpolating, with a log scale, a relationship between the dimming change display luminance and the third black gray scale voltage and a relationship between the second display luminance and the second black gray scale voltage.

11. The driving voltage setting device of claim 1, wherein:

the first voltage determiner is configured to provide the first black gray scale voltage and the second black gray scale voltage to the display device; and the second voltage determiner is configured to provide the black gray scale voltages to the display device.

12. The driving voltage setting device of claim 1, further comprising:

a third voltage determiner configured to determine low-power voltages and initialization voltages that correspond to the respective display luminances such that light emitting elements of the display device are driven in a saturation region with respect to the respective display luminances.

13. A method of setting a driving voltage for a display device, the method comprising:

determining low-power voltages and initialization voltages that respectively correspond to preset display luminances such that light emitting elements of the display device are driven in a saturation region with respect to the respective display luminances;

determining a first black gray scale voltage corresponding to a maximum display luminance of the display device based on a variable preliminary black gray scale voltage under a maximum luminance condition;

determining a second black gray scale voltage corresponding to a minimum display luminance of the display device based on the variable preliminary black gray scale voltage under a minimum luminance condition; and determining black gray scale voltages corresponding to the respective display luminances, except the maximum display luminance and the minimum display luminance, based on the first black gray scale voltage and the second black gray scale voltage.

14. The method of claim 13, wherein:

the maximum display luminance condition comprises information on a low-power voltage, an initialization voltage, and an off-duty ratio that correspond to the maximum display luminance; and the minimum display luminance condition comprises information on a low-power voltage, an initialization voltage, and an off-duty ratio that correspond to the minimum display luminance.

15. The method of claim 13, wherein determining the first black gray scale voltage comprises:

comparing a measured luminance using the variable preliminary black gray scale voltage with a preset threshold black luminance under the maximum display luminance condition;

decreasing the variable preliminary black gray scale voltage corresponding to the measured luminance in response to the measured luminance being less than or equal to the threshold black luminance; and determining, as the first black gray scale voltage, a value obtained by applying a first margin to the variable preliminary black gray scale voltage corresponding to the measured luminance in response to the measured luminance being greater than the threshold black luminance.

16. The method of claim 13, wherein determining the second black gray scale voltage comprises:

comparing a measured luminance using the variable preliminary black gray scale voltage with a preset threshold black luminance under the minimum display luminance condition;

decreasing the variable preliminary black gray scale voltage corresponding to the measured luminance in response to the measured luminance being less than or equal to the threshold black luminance; and determining, as the second black gray scale voltage, a value obtained by applying a second margin to the variable preliminary black gray scale voltage corresponding to the measured luminance in response the measured luminance being greater than the threshold black luminance.

17. The method of claim 13, wherein determining the black gray scale voltages comprises:

determining a value obtained by applying a preset offset to the first black gray scale voltage as a third black gray scale voltage corresponding a dimming change display luminance;

determining the black gray scale voltages corresponding to the display luminances between the minimum display luminance and the dimming change display luminance by linearly interpolating, with a log scale, a relationship between the dimming change display luminance and the third black gray scale voltage and a relationship between the minimum display luminance and the second black gray scale voltage; and providing the display device with the black gray scale voltages, the black gray scale voltages comprising the first and second black gray scale voltages, wherein the dimming change display luminance corresponds to a reference at which the dimming mode of the display device is changed among the display luminances.

18. A display device comprising:

a display panel comprising a plurality of pixels;

a controller configured to control, according to preset display luminances, each of a low-power voltage and a black gray scale voltage;

a scan driver configured to provide a scan signal to the display panel through a scan line; and a data driver configured to:

generate a data voltage corresponding to a display image based on the black gray scale voltage; and provide the data voltage to the display panel through a data line, wherein the controller comprises:

a memory configured to store a first black gray scale voltage applied in association with a maximum display luminance and a second black gray scale voltage applied in association with a minimum display luminance;

a first calculator configured to determine a value obtained via application of a preset offset to the first black gray scale voltage as a third black gray scale voltage applied to a dimming change display luminance among the display luminances; and a second calculator configured to determine a target black gray scale voltage applied to a target display luminance at which the display panel is to emit light via interpolation of a relationship between the dimming change display luminance and the third black gray scale voltage and a relationship between the minimum display luminance and the second black gray scale voltage.

19. The display device of claim 18, wherein the second calculator is configured to perform the interpolation via conversion of the display luminance with a log scale.

* * * * *